US011540569B2

(12) United States Patent
Seiz

(10) Patent No.: US 11,540,569 B2
(45) Date of Patent: Jan. 3, 2023

(54) TACTICAL GLOVE

(71) Applicant: Friedrich Seiz GmbH, Metzingen (DE)

(72) Inventor: Rainer Seiz, Metzingen (DE)

(73) Assignee: Friedrich Seiz GmbH, Metzingen (DE)

( * ) Notice: Subject to any disclaimer, the term of this patent is extended or adjusted under 35 U.S.C. 154(b) by 0 days.

(21) Appl. No.: 17/343,762

(22) Filed: Jun. 10, 2021

(65) Prior Publication Data

US 2022/0354197 A1 Nov. 10, 2022

(30) Foreign Application Priority Data

May 6, 2021 (DE) ..... 102021111851.4

(51) Int. Cl.
*A41F 1/06* (2006.01)
*A41D 19/015* (2006.01)
*A41D 19/00* (2006.01)

(52) U.S. Cl.
CPC ... *A41D 19/0048* (2013.01); *A41D 19/01529* (2013.01); *A41F 1/06* (2013.01); *A41D 2300/32* (2013.01); *A41D 2300/322* (2013.01); *A41D 2300/33* (2013.01)

(58) Field of Classification Search
CPC ..... A41D 19/0048; A41D 19/01529; A41D 2300/32; A41D 2300/322; A41D 2300/33; A41F 1/06
See application file for complete search history.

(56) References Cited

U.S. PATENT DOCUMENTS 4,868,927 A * 9/1989 Bourdeau ..... A41F 1/06 2/920
5,020,161 A * 6/1991 Lewis, Jr ..... A41D 13/0005 2/164
5,073,988 A * 12/1991 Lewis, Jr ..... A41D 19/0041 2/270
5,356,322 A * 10/1994 Bakalis ..... A63B 31/04 441/57
10,368,616 B2 * 8/2019 Burke ..... A41F 1/00
2002/0062514 A1 * 5/2002 Soter ..... A41D 19/0037 2/160
2008/0263747 A1 * 10/2008 DeBlasis ..... A41F 1/06 2/163
2014/0096306 A1 * 4/2014 Hill ..... A41D 19/0034 2/158
2016/0338453 A1 * 11/2016 Kojima ..... A44B 19/06
2018/0255848 A1 * 9/2018 Moreau ..... A41D 19/01
2021/0378332 A1 * 12/2021 Tryner ..... A41D 19/0048

FOREIGN PATENT DOCUMENTS

EP 3698664 A1 8/2020

* cited by examiner

*Primary Examiner* — Clinton T Ostrup
*Assistant Examiner* — Akwokwo Olabisi Redhead
(74) *Attorney, Agent, or Firm* — Michael Soderman

(57) ABSTRACT

A tactical glove (1) with a glove body (2), glove fingers (3*a* to 3*e*) and a sheath (4) adjoining the glove body (2). A closure system is provided in the form of a strap (5). The strap is fastened at one end to the tactical glove (1) and has a mechanical closure (6) that is moved onto a corresponding mechanical closure (7) by a closing movement of the strap (5) in order to constrict the sheath (4), via which a mechanical closure is formed. On the sheath (4) a zipper (8) is provided, the slider (9) of which is joined to the strap (5) by a coupling such that when a closing movement of the strap (5) is performed, the zipper (8) closes. The strap (5) forms a wrist support.

15 Claims, 3 Drawing Sheets

TACTICAL GLOVE

CROSS REFERENCE TO RELATED APPLICATIONS

This application claims the priority of DE 102021111851.4 filed on 2021 May 6; this application is incorporated by reference herein in its entirety.

BACKGROUND

The invention concerns a tactical glove.

Such tactical gloves are generally worn by persons engaged in action in places where harsh environmental conditions can exist. Accordingly, the tactical gloves are composed of stable materials that are resistant to such environmental conditions.

This applies above all to tactical gloves in the form of firefighter safety gloves. These are not only more exposed to strong splashing water, but also to high temperatures.

To adequately protect a person in such work situations, it is not sufficient for the tactical glove itself to ensure protection against environmental conditions. Rather, it is necessary for the tactical glove to form a leak-tight joint with a tactical jacket that is worn by a person engaged in an action, in particular to prevent water from penetrating between the tactical glove and the tactical jacket.

To meet these requirements, designing tactical gloves as cuffed gloves is known. Such a cuffed glove has a cuff on the glove body that is pulled over the tactical jacket. The advantage of such a cuffed glove is that the forearm of a person wearing the cuffed glove is completely covered. Moreover, it is advantageous that the cuffed glove can be relatively easily pulled on, although pulling the cuff over the tactical jacket requires a certain amount of time.

An essential disadvantage of cuffed gloves is that fluids, in particular water, can penetrate into the cuffed glove from above via the sleeves of the tactical jacket, which is problematic in particular when engaged in action in the rain.

Moreover, using tactical gloves tailored to be longer, for example such that a knitted cuff adjoins the glove, is known. The knitted cuff of the tactical glove is then worn under the sleeve of the tactical jacket, which, when the knitted cuff is tucked under the tactical jacket, is then closed by means of a zipper. It is advantageous here that the fluids, as well as hazardous substances, cannot enter the tactical glove via the tactical jacket. It is disadvantageous, however, that putting on such a tactical glove is relatively difficult and time-consuming, since tucking the knitted cuff under the tactical jacket is cumbersome.

A generic tactical glove is known from EP 3 698 664 A1.

SUMMARY

The invention concerns a tactical glove (1) with a glove body (2), glove fingers (3*a* to 3*e*) and a sheath (4) adjoining the glove body (2). A closure system is provided in the form of a strap (5). The strap is fastened at one end to the tactical glove (1) and has a mechanical closure means (6) that is moved onto a corresponding mechanical closure means (7) by a closing movement of the strap (5) in order to constrict the sheath (4), by which means a mechanical closure is formed. On the sheath (4) a zipper (8) is provided, the slider (9) of which is joined to the strap (5) by a coupling means such that when a closing movement of the strap (5) is performed, the zipper (8) closes. The strap (5) forms a wrist support.

DETAILED DESCRIPTION

The invention seeks to solve the problem of improving the functionality of a tactical glove of the type mentioned at the outset.

To solve this problem, the features of claim 1 are provided. Advantageous embodiments and useful further developments of the invention are described in the dependent claims.

The invention concerns a tactical glove with a glove body, glove fingers and a sheath that connects to the glove body. A closure system is provided in the form of a strap. The strap is fastened at one end to the tactical glove and has a mechanical closure means, which is moved onto a corresponding mechanical closure means by a closing movement of the strap in order to constrict the sheath, by which means a mechanical closure is effected. A zipper is provided on the sheath, the slider of which zipper is connected to the strap by a coupling means such that the zipper closes when the closing movement of the strap is performed. The strap forms a wrist support.

The tactical glove is designed for engagements in action outdoors, being designed to be resistant against harsh environmental conditions, such as splashed water and high temperatures. For this purpose, the tactical glove is composed of correspondingly resistant materials, in particular water-tight and temperature-resistant materials.

The tactical glove has an extension in the form of a sheath that connects to the glove body and advantageously the tactical glove is composed of the same material as the sheath.

The sheath is equipped with a closure system that has a mechanical closure means, on the one hand, and a zipper, on the other hand. According to the invention, the slider of the zipper is connected by a coupling means to the strap that has a mechanical closure means, by means of which they are motion-coupled. In this way, by performing a closure movement of the strap, whereby the mechanical closure means on the strap is moved onto a corresponding mechanical closure means arranged preferably directly on the sheath, the slider of the zipper is moved along by the coupling means, such that the zipper automatically closes. The same applies in reverse to opening the mechanical closure formed by the mechanical closure means. If the strap with the mechanical closure means is raised off of the corresponding mechanical closure means, the zipper opens automatically via the coupling means.

Therefore by the coupling of the strap to the zipper, the mechanical closure can be opened and closed using the mechanical closure means solely by a movement of the strap, and the zipper can be opened or closed simultaneously.

Cumbersome manual operation of the zipper is therefore completely dispensed with. The strap can be operated much more easily by a person who is already wearing a tactical glove than can the slider of a zipper. The operation of the closure system according to the invention is therefore extremely simple and user-friendly.

Another essential advantage of the invention is that the closure system according to the invention can be opened and closed very rapidly, such that the requirements of Standard DIN EN 659:2008-06 can be met. For use of the tactical glove as a firefighter glove, this standard requires that it be capable of being opened within 3 seconds time, maximum. This requirement is satisfied by the tactical glove according to the invention such that it can be used as a firefighter glove.

Of course, the tactical glove according to the invention can also be used in other areas of application, such as a police glove or rescue glove.

By closing the zipper, the tactical glove according to the invention is constricted in the region of the sheath. It is especially advantageous that when the zipper is closed, the sheath is constricted over the entire length of the zipper. The strap with the mechanical closure means augments this effect when the strap is closed and its mechanical closure means is in contact with the corresponding mechanical closure means and forms the mechanical closure. Furthermore, the mechanical closure forms an additional safeguard, since the strap lies above the zipper and partially covers it.

By constricting the sheath of the tactical glove according to the invention, the latter can be simply and rapidly inserted into the sleeve of a tactical jacket. The sleeve guided over the sheath securely and reliably prevents fluids or hazardous materials from penetrating between the tactical glove and tactical jacket. The tactical glove according to the invention therefore has high functionality.

According to an ergonomically advantageous embodiment, the zipper is arranged on the back of the sheath. Of course, the zipper can also be provided on the inside of the sheath as well.

According to an advantageous embodiment, the mechanical closure means are provided in the form of hook-and-loop fasteners.

To create the mechanical closure, the hook-and-loop fasteners only have to be pressed against one another, which can be accomplished very easily. The mechanical closure can be detached just as easily by pulling the first hook-and-loop fastener away from the second hook-and-loop fastener.

Introducing the hook-and-loop fastener on the strap onto the corresponding hook-and-loop fastener becomes especially easy when the latter is directly arranged on the back of the tactical glove. Of course, variants are conceivable wherein the corresponding hook-and-loop fastener is itself fastened to a strap.

The mechanical closure means are generally not restricted to hook-and-loop fasteners. Other closure means can be used as well, in principle, such as hooks or similar.

The coupling means that connects the strap to the slider of the zipper is generally formed by a flexible, i.e. easily bendable, element which however is not elastically deformable in the longitudinal direction and therefore cannot be extended in length. In this way, a reproducible motion-coupling of the strap to the zipper is obtained. It is especially advantageous for a cord to be provided as the coupling means, the one longitudinal end of which cord is connected to the strap and the second longitudinal end of which cord is connected to a pull tab on the slider of the zipper.

To accomplish the automatic opening and closing of the zipper according to the invention solely by a movement of the strap for opening and closing the mechanical closure, the dimensioning and arrangement of the strap with the mechanical closure means and the corresponding mechanical closure means, as well as of the zipper, are coordinated with one another.

So that an effective constriction of the tactical glove is effected by the mechanical closure, it is advantageous for the strap in its closed position to run transverse relative to the longitudinal direction of the tactical glove.

Adapted to this, the longitudinal axis of the zipper runs obliquely relative to the longitudinal direction of the tactical glove.

It is advantageous for the longitudinal axis of the zipper to run at an angle of inclination $\alpha$ of $0° < \alpha < 90°$.

It is especially advantageous for the angle of inclination $\alpha$ to be in the range $20° < \alpha < 60°$.

Accordingly, if the strap is moved transversely relative to the longitudinal direction of the tactical glove in order to open or close the mechanical closure, when the strap is moved, by way of the connection of the slider to the strap with the coupling means, a component of force is always generated on the tab, which component of force is directed in the longitudinal direction of the zipper and in this way effects an opening or closing of the zipper.

The adaptation of the individual components of the closure system is done such that upon the closing or opening movement of the strap, the zipper is completely closed or opened. This can be achieved surprisingly easily by selecting a suitable length of the zipper and by selecting a suitable orientation of the zipper on the sheath at the angle of inclination of the latter toward the longitudinal direction of the tactical glove.

According to the invention, the strap forms a wrist support. This wrist support stabilizes the wrist of a person wearing the tactical glove and thus protects the wrist against excessive loads or injuries.

When engaged in action, the person wearing the tactical glove is exposed to high loads, particularly in the wrist region, whereby in particular sprains can occur in the wrist region. The wrist support according to the invention provides effective protection against this.

It is especially advantageous for the width and position of the strap to be dimensioned such that the strap completely covers the wrist region of a person wearing the tactical glove.

It is further advantageous for the strap in its closed position to completely enclose the sheath.

In this way, the wrist of a person wearing the tactical glove is completely and on all sides enclosed by the wrist support, and therefore the wrist is completely protected.

According to an advantageous embodiment, the support effect of the strap is provided by its material thickness.

In this case, the material of the strap can be identical to the material of the glove body and the sheath. Due to the increased material thickness, i.e. greater thickness of the strap, it has enhanced stiffness and therefore its protective effect ensues.

Alternatively or additionally, material reinforcements can be worked into the strap.

In this case, the material reinforcements ensure enhanced stiffness.

It is advantageous for the material reinforcements to be made of aramid and/or para-aramid fibers.

According to an advantageous embodiment, the strap is composed of a flame-retardant material.

Of course, the glove body and the sheath can also be composed of fire-retardant material. This is especially advantageous for tactical gloves in the form of firefighter gloves.

BRIEF DESCRIPTION OF THE DRAWINGS

The invention is explained below based on the drawings. They show.

DETAILED DESCRIPTION OF THE PREFERRED EMBODIMENTS

Figure 1:
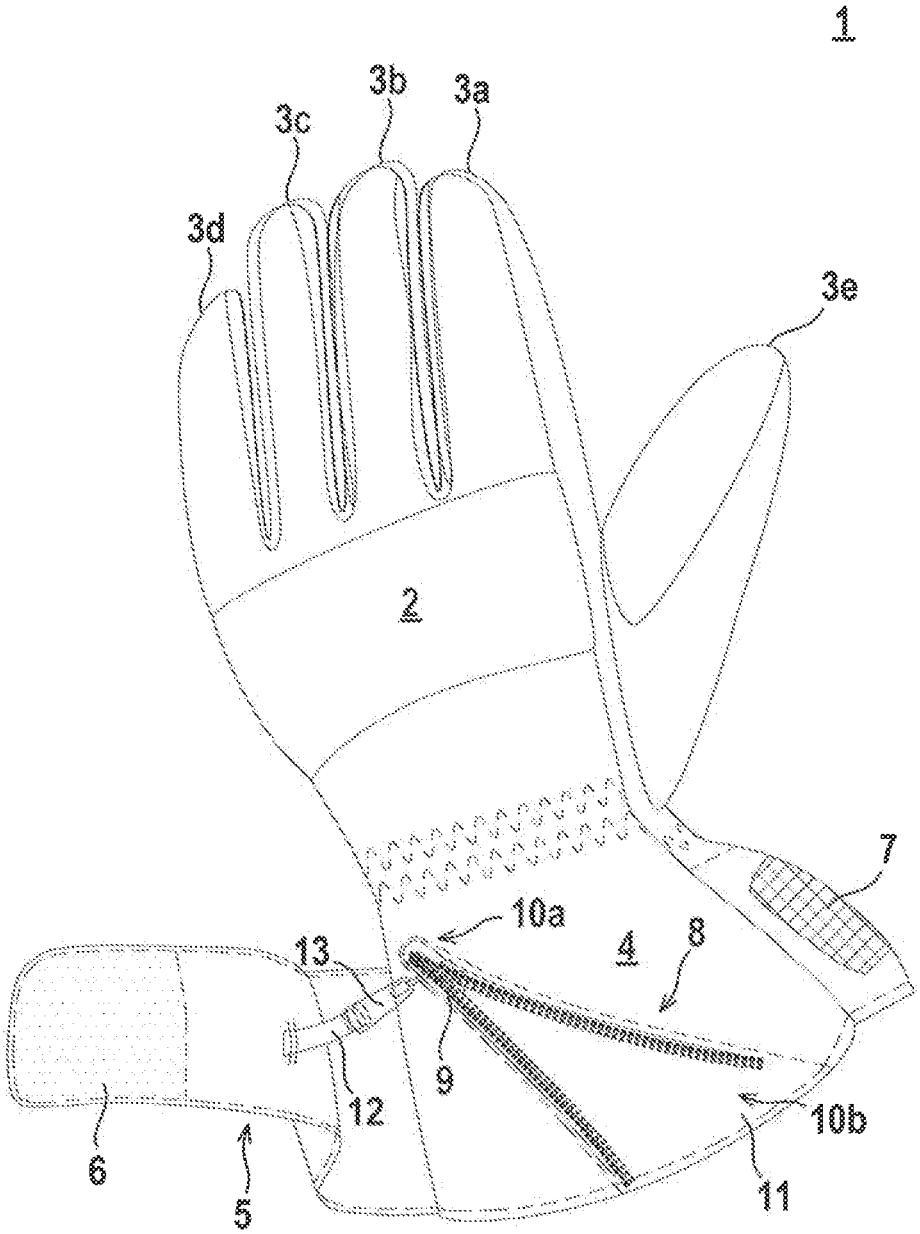
FIG. 1: Exemplary embodiment of the tactical glove according to the invention with opened closure system.
Figure 2:
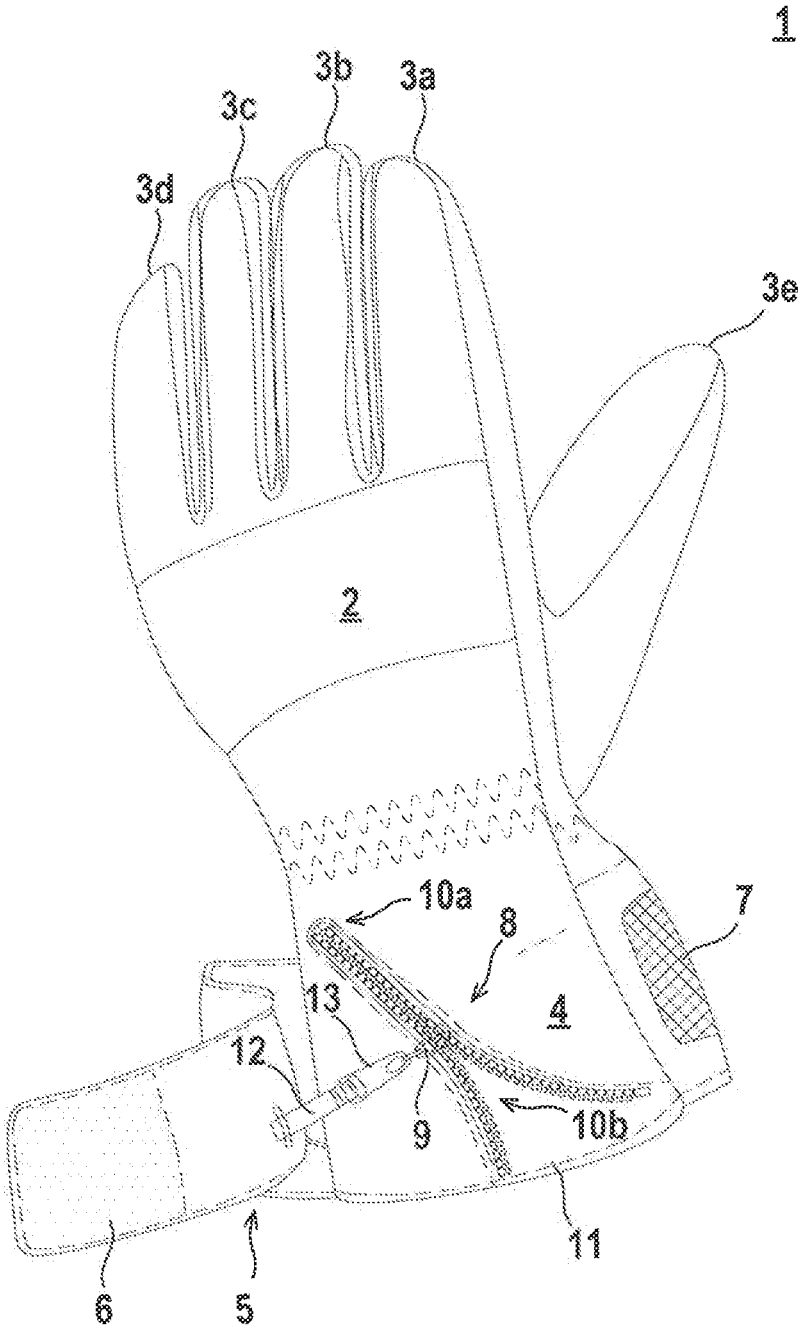
FIG. 2: Tactical glove from FIG. 1 with partially closed closure system.
Figure 3:
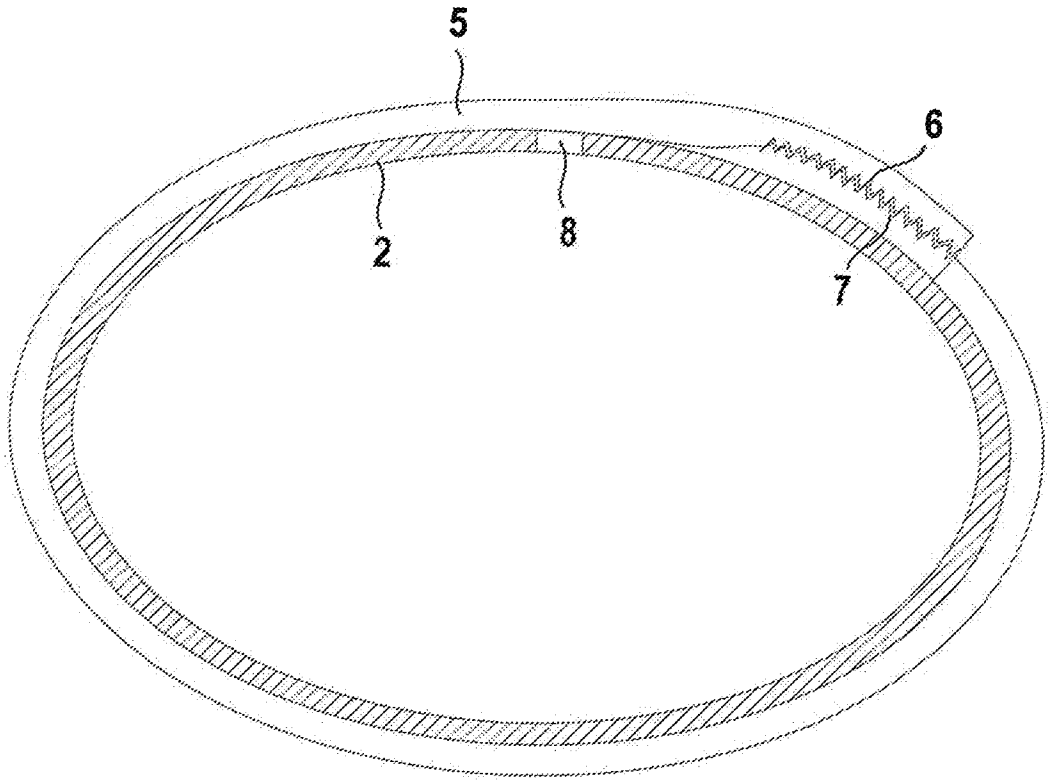
FIG. 3: Strap in its closed position.

FIGS. 1 and 2 show an exemplary embodiment of the tactical glove 1 according to the invention. In the present case, the tactical glove 1 is designed as a firefighter glove and preferably is composed on the exterior of water-tight or water-repellant and also heat-resistant, flame-retardant materials. Alternatively, the tactical glove 1 can also be designed as a police glove or rescue glove.

The tactical glove 1 is designed as a glove with fingers and therefore has a glove body 2 with five connecting glove fingers 3*a* to 3*e*, wherein a glove finger 3*e* is designed as a thumb.

The tactical glove 1 has an extension in the form of a sheath 4, which is composed of the same material as the glove body 2.

A closure system is provided on the sheath 4. The closure system is composed, on the one hand, of a mechanical closure system. This comprises, on the one hand, a strap 5 with a mechanical closure means 6 in the form of a hook-and-loop fastener and on the other hand, a corresponding mechanical closure means 7, which is also designed in the form of a hook-and-loop fastener.

The hook-and-loop strip forming the mechanical closure means 6 is fastened on the inside of the strap 5 in the region of its free end, preferably sewn on.

The hook-and-loop strip forming the corresponding mechanical closure means 7 is fastened to the sheath in the region of the inner side of the tactical glove 1, preferably sewn on.

The longitudinal axis of the corresponding mechanical closure means 7 runs transverse relative to the longitudinal axis of the tactical glove 1. Abutting the corresponding mechanical closure means 7, the strap 5 is fastened on the inner side of the sheath 4, especially by sewing together. The longitudinal axis of the strap 5 runs transverse relative to the longitudinal direction of the tactical glove 1.

The length of the strap 5 is dimensioned such that it completely encloses the sheath 4 and such that the mechanical closure means 6 can be fastened to the corresponding mechanical closure means 7. In this closed position of the strap 5, the latter completely wraps around the sheath 4.

The width and position of the strap 5 are dimensioned such that the strap 5 completely covers the wrist region of a person wearing the tactical glove 1.

Therefore in its closed position, the strap 5 forms a wrist support according to the invention.

The supportive effect of the strap 5 can be provided by its material thickness.

In this case, the strap 5 has greater stiffness compared to the glove body 2 and the sheath 4, such that the strap 5 provides a supportive effect for the wrist of a person wearing the tactical glove 1.

Alternatively or additionally, this supportive effect is obtained by working material reinforcements into the strap 5.

In particular, the material reinforcements are composed of aramid and/or para-aramid fibers.

It is especially advantageous for the strap 5 to be composed of a flame-retardant material.

The strap 5 forms a flexible bendable body. With this system, a mechanical closure is formed by a person grasping the strap 5 and moving the mechanical closure means 6 provided there toward the corresponding mechanical closure means 7 directly on the tactical glove. Once the hook-and-loop fasteners forming the mechanical closure means 6, 7 are pressed against one another, the mechanical closure is formed. This effects a constriction of the sheath 4. In the closed state, the strap 5 runs transversely, i.e. perpendicular, relative to the longitudinal direction of the tactical glove 1.

According to the invention, the closure system additionally has a zipper 8, which has a slider 9 in the known manner with which the zipper 8 can be opened. In the known manner, the zipper 8 has two strips that are brought together at a closed end 10*a*. The opposing open end 10*b* of the zipper 8 can be closed using the slider 9.

To ensure that the forearm of a person wearing the tactical glove 1 is not exposed, an insert part 11 that covers the open area is arranged under the zipper 8.

According to the invention, the slider 9 is coupled to the strap 5 by a coupling means. In the present case, the coupling means is composed of a cord 12 that is fastened at the other longitudinal end to a pull tab 13 on the slider 9 of the zipper 8. The cord 12 is a flexible, bendable, flat body, wherein the cord 12 is not elastic in the longitudinal direction. Preferably, the cord is composed of a textile material.

The slider 9 is motion-coupled to the strap 5 by the cord 12. According to the invention the coupling is designed such that during a closing movement of the strap 5 (i.e. when the mechanical closure means 6 is moved toward the corresponding mechanical closure means 7), the zipper 8 is automatically closed, and during an opening movement of the strap (i.e. when the mechanical closure means 6 is moved away from the corresponding mechanical closure means 7), the zipper 8 is automatically opened.

This is accomplished by suitably dimensioning the length of the zipper 8 as well as by suitably orienting the zipper 8 on the back of the sheath 4. This is illustrated in FIGS. 1 and 2.

It is essential for the longitudinal axis of the zipper 8 to run obliquely relative to the longitudinal direction. The angle of inclination $\alpha$ of the longitudinal axis of the zipper 8 relative to the longitudinal direction of the tactical glove 1 is in the range $0<\alpha<90°$, i.e. the longitudinal axis of the zipper 8 runs not only obliquely relative to the longitudinal direction of the tactical glove 1, but also inclined relative to the transverse direction, in which the strap 5 runs when the mechanical closure is effected.

It is advantageous for the angle of inclination to be in the range $20°<\alpha<60°$. In the present case, it is especially preferable for the angle of inclination $\alpha$ to be between 35° and 40°.

Furthermore, it is essential for the open end 10*b* of the zipper 8 to be oriented farther toward the edge of the sheath 4 than the closed end 10*a* of the zipper 8. In the present case, the open end 10*b* of the zipper 8 opens out at the edge of the sheath 4, while the closed end 10*a* of the zipper 8 lies in the region of the sheath 4 facing toward the glove body 2. The closed end 10*a* of the zipper 8 thus lies closer to where the strap 5 is fastened onto the tactical glove 1 than does the open end 10*b*.

This design and arrangement of the zipper 8 relative to the strap 5 allows the zipper 8 to be automatically operated and opened and closed by opening and closing of the strap 5.

In the arrangement from FIG. 1, the mechanical closure means 6 is separated from the corresponding mechanical closure means 7 by pulling away the strap 5, by which means the zipper 8 is opened.

In the arrangement from FIG. 2, the strap 5 with the mechanical closure means 6 is just being moved in the direction of the corresponding mechanical closure means 7, such that the zipper 8 is moved in the direction of the closed position.

Once the strap 5 is in its closed position and the hook-and-loop fasteners are abutting one another, forming the mechanical closure, the zipper 8 is completely closed, whereby the sheath is constricted over the entire length of the zipper 8. The mechanical closure supports the constriction and lies protectively over the zipper 8.

In this state, the sheath 4 of the tactical glove 1 can be easily inserted into a sleeve of a tactical jacket. A person wearing the tactical jacket and the tactical gloves 1 is therefore well protected against environmental conditions, since no fluids or hazardous substances can penetrate between the tactical gloves 1 and the tactical jacket.

LIST OF REFERENCE NUMERALS (1) tactical glove
(2) glove body
(3*a*-3*e*) glove finger
(4) sheath
(5) strap
(6) mechanical closure means
(7) corresponding mechanical closure means
(8) zipper
(9) slider
(10*a*) closed end
(10*b*) open end
(11) insert part
(12) cord
(13) pull tab

The invention claimed is:

1. A tactical glove (1) with a glove body (2), glove fingers (3*a* to 3*e*) and a sheath (4) adjoining the glove body (2), wherein a closure system is provided in the form of a strap (5), which is fastened to the tactical glove (1) at one end and has a mechanical closure (6) that is moved onto a corresponding mechanical closure (7) by a closing movement of the strap (5) in order to constrict the sheath (4), whereby a mechanical closure is formed, and wherein on the sheath (4) a zipper (8) is provided, a slider (9) of which is joined to the strap (5) by a coupling means such that when a closing movement of the strap (5) is performed, the zipper (8) closes, characterized in that the strap (5) forms a wrist support and that the coupling means is composed of a cord that is not elastic in the longitudinal direction so that when the strap 5 is brought to its closed position, the zipper (8) is also brought to its closed position.

2. The tactical glove (1) according to claim 1, characterized in that the width and position of the strap (5) are dimensioned such that the strap (5) is adapted to completely cover the wrist region of a person when wearing the tactical glove.

3. The tactical glove (1) according to claim 1, characterized in that the supportive effect of the strap (5) is provided by its material thickness.

4. The tactical glove (1) according to claim 1, characterized in that the strap (5) has greater stiffness than the glove body (2).

5. The tactical glove (1) according to claim 4, characterized in that material reinforcements are worked into the strap (5).

6. The tactical glove (1) according to claim 5, characterized in that the material reinforcements are composed of aramid and/or para-aramid fibers.

7. The tactical glove (1) according to claim 1, characterized in that the strap (5) is composed of a flame-retardant material.

8. The tactical glove (1) according to claim 1, characterized in that the mechanical closure (6, 7) are provided in the form of hook-and-loop fasteners.

9. The tactical glove (1) according to claim 1, characterized in that a cord (12) is provided as coupling, the one longitudinal end of which cord (12) is joined to the strap (5) and the second longitudinal end of which cord (12) is joined to a pull tab (13) on the slider (9) of the zipper (8).

10. The tactical glove (1) according to claim 1, characterized in that the zipper (8) is arranged on the back of the sheath (4).

11. The tactical glove (1) according to claim 1, characterized in that the corresponding mechanical closure (7) are fastened directly on the sheath (4).

12. The tactical glove (1) according to claim 1, characterized in that the longitudinal axis of the zipper (8) runs obliquely relative to the longitudinal direction of the tactical glove (1), and in that the closing and opening movement of the strap (5) runs transversely relative to the longitudinal direction of the tactical glove (1).

13. The tactical glove (1) according to claim 12, characterized in that the longitudinal axis of the zipper (8) runs at an angle of inclination $\alpha$ of $0° < \alpha < 90°$ relative to the longitudinal direction of the tactical glove (1).

14. The tactical glove (1) according to claim 13, characterized in that the angle of inclination $\alpha$ is in the range $20° < \alpha < 60°$.

15. The tactical glove (1) according to claim 1, characterized in that it is designed as a firefighter glove, police glove or rescue glove.

* * * * *